United States Patent [19]

Irvine et al.

[11] 3,996,727

[45] Dec. 14, 1976

[54] ENVELOPE FLAP SEPARATING MECHANISM

[75] Inventors: Robert Irvine, Riverside; Harry E. Luperti, Wilton, both of Conn.

[73] Assignee: Pitney-Bowes, Inc., Stamford, Conn.

[22] Filed: Jan. 13, 1976

[21] Appl. No.: 648,752

[52] U.S. Cl. ..... 53/381 R

[51] Int. Cl.[2] ..... B65B 43/39

[58] Field of Search ..... 53/381 R, 384, 266 A

[56] References Cited

UNITED STATES PATENTS

| | | | |
|---|---|---|---|
| 1,317,387 | 9/1919 | Penney et al. | 53/266 A X |
| 2,301,354 | 11/1942 | Alden | 53/266 A X |
| 3,015,926 | 1/1962 | Galambos | 53/266 A X |
| 3,474,711 | 10/1969 | Swinyar | 53/384 X |

*Primary Examiner*—Travis S. McGehee
*Attorney, Agent, or Firm*—William D. Soltow, Jr.; Albert W. Scribner; Robert S. Salzman

[57] ABSTRACT

A flap separating mechanism for distending a flap from a body portion of an envelope.

An envelope moving through a mail handling system may require its flap to be moistened and sealed. As a prelude to the moistening procedure, the flap of the envelope must be separated from the body portion. The separating mechanism disclosed herein comprises a rotatably affixed belt conveyor and an adjacent ski-like stripper member. The stripper member is movably biased toward said conveyor to provide a normal force on envelopes disposed therebetween.

The deflapping mechanism can accommodate envelopes of varying thickness, while providing a fixed plane for the printing of postage on the body portion of the envelopes.

1 Claim, 1 Drawing Figure

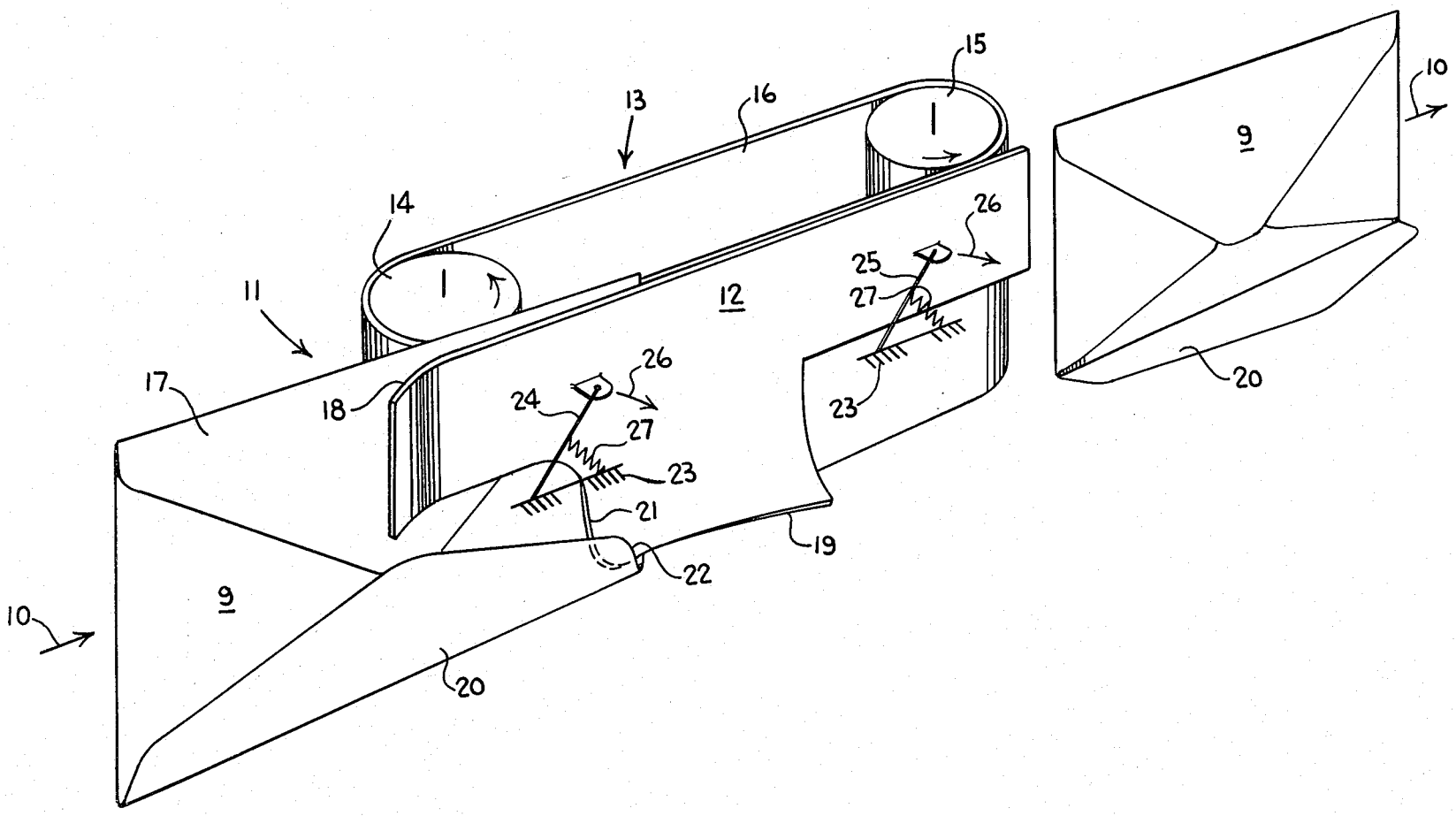
10
16
20
15
26
25
27
23
19
16
12
13
22
26
23
27
21
24
20
14
18
11
16
17
10

ENVELOPE FLAP SEPARATING MECHANISM

This invention pertains to flap separating mechanisms, and more particularly to a flap separating mechanism that can accommodate envelopes of varying thickness.

BACKGROUND OF THE INVENTION

With the modern day need for high speed mail handling systems, it has been found useful to transport envelopes along a mail handling feed path with a vertical orientation. This vertical orientation requires that many basic functions provided by prior machines, such as moistening and sealing of the envelope, require new mechanisms due to the differences in the mail handling orientation.

In previous envelope deflapping designs, the stripper blade has always been a fixed item. The envelope was always registered against the fixed blade to allow the flap to part from the body of the envelope. This type of design, however, could not adequately accommodate envelopes of varying thickness. In addition, a fixed printing plane for the printing of postage was also not always provided, as with the present invention.

The invention also provides the capability of allowing sealed mail to pass the stripper blade without being damaged or cut.

SUMMARY OF THE INVENTION

The invention relates to a mechanism for separating and distending a flap from the body portion of an unsealed envelope. An envelope having a vertical orientation is introduced into the bite of a rotatably fixed conveyor and an adjacent stripper member.

The stripper and conveyor are adjacently disposed along a feed path. The conveyor belt provides a fixed plane for the printing of postage on the envelope. Because the conveyor surface is fixed, the stripper member is movably biased toward the conveyor to accommodate for different thicknesses of envelopes. The stripper member is ski-shaped about its forward upper end to guide incoming envelopes into the bite formed between the stripper and the conveyor. A lower end of the stripper member contains a curved surface for forcing the flap of the envelope to distend (deflap) from the envelope body as the envclope is transported past the stripper.

A parallelogram linkage is connected to the stripper member for causing this member to uniformly translate with respect to the belt conveyor. This will provide for the uniform accommodation and transportation of the envelope, while in the bite of the conveyor.

It is an object of this invention to provide an improved envelope flap separating and distending apparatus;

It is another object of the invention to provide an envelope flap separating and distending apparatus that can accommodate different thicknesses of envelopes; and It is a further object of this invention to provide an envelope flap separating and distending apparatus, that has a fixed printing plane.

These and other objects of the invention will be better understood and will become more apparent with reference to the following detailed description taken in conjunction with the attached drawing, in which a perspective view of the flap separating and distending apparatus of this invention is shown.

Now referring to the attached FIGURE, an envelope 9 is shown moving along a feed path depicted by arrow 10. The envelope 9 enters a bite 11 formed between a stripper member 12 and a belt conveyor 13. The belt conveyor 13 comprises two rollers 14 and 15 between which is stretched a belt 16. Either roller may be a drive roller. Each roller is rotatably fixed so that the conveyor belt 16 provides a fixed plane for the body 17 of envelope 9.

The stripper member 12, comprises an upper front ski-like portion 18 that acts as a guide for envelope 9. A lower portion 19 of the stripper member 12 has a blade face 21 for entering between the flap 20 and the body 17 of the envelope 9.

As the envelope continues to move past the blade face 21, the forward section 22 of the flap 20 engages with a flaired surface 19. The flaired surface 19 causes the flap 20 to distend from the body 17 of the envelope 9. The envelope 9 then discharges from between the stripper member 12 and the conveyor 13 with the flap 20 completely distended as shown.

The stripper member 12 is attached to a suitable frame 23 (schematically illustrated) by means of a parallelogram linkage comprising pivotably fixed links 24 and 25, respectively. This allows the stripper member 12 to pivotably translate (arrows 26) with respect to the conveyor 13. This allows the envelope 9 to enter bite 11 without jamming despite its thickness. It also allows the envelope to be smoothly and uniformly conveyed between the stripper and belt members. A slight gap is also provided between the belt and the stripper member to prevent the four bar linkage from jamming.

A pair of compression springs 27 allow the stripper member 12 to be biased towards belt 16 to create a normal force against envelope 9.

Having described our invention, what is sought to be protected by Letters Patent is presented by the appended claims.

What is claimed is:

1. An envelope deflapping apparatus for opening the flaps of unsealed vertically oriented envelopes of varying thicknesses, comprising:

means defining a vertically oriented envelope feed path;

a belt conveyor disposed adjacent said feed path which is rotatably affixed to provide a fixed plane for a body portion of an envelope being transported thereby;

a ski-like stripper member disposed adjacent said conveyor and movably biased toward said conveyor to provide a normal force for envelopes of varying thickness being transported by said conveyor, said ski-like stripper member comprising an upper curved portion for guiding said body portion of an envelope into a bite formed between said conveyor and said stripper member, and a lower flaired portion for engagement with a flap portion of an envelope, said lower flaired portion causing the flap portion of the envelope to separate from the body portion of the envelope as said envelope is transported past said stripper member by said belt conveyor; and a parallelogram linkage connected to said stripper member for causing said stripper member to uniformly translate with respect to said belt conveyor, whereby envelopes of varying thickness will be uniformly accommodated and transported in the bite formed between the conveyor and said stripper member.

* * * * *